United States Patent [19]

Broadfoot et al.

[11] Patent Number: 4,529,106

[45] **Date of Patent: * Jul. 16, 1985**

[54] METERING AND/OR FEEDING UNIT FOR FLUID MATERIALS

[76] Inventors: John T. Broadfoot, 805 Eighth Southwest, Everett, Wash. 98204; John T. Broadfoot, Jr., Rte. 3, Box 3191, Sunnyside, Wash. 98944

[ * ] Notice: The portion of the term of this patent subsequent to Oct. 4, 2000 has been disclaimed.

[21] Appl. No.: 414,006

[22] Filed: Sep. 2, 1982

[51] Int. Cl.[3] ..... F04B 19/12; B67D 5/08

[52] U.S. Cl. ..... 222/207; 222/214; 417/475; 417/477; 417/510; 406/119

[58] Field of Search ..... 222/206, 207, 214, 215, 222/271, 274, 445, 448, 450; 406/65, 81, 50, 119, 120; 417/474, 475, 477, 510, 900

[56] References Cited

U.S. PATENT DOCUMENTS

| | | | |
|---|---|---|---|
| 1,815,403 | 7/1931 | Goebels | 406/120 |
| 1,922,196 | 8/1933 | Butler | 417/474 X |
| 2,015,123 | 2/1935 | Pennell | 417/477 |
| 2,326,302 | 8/1943 | Linstedt | 417/510 X |
| 2,629,333 | 2/1953 | Olden | 417/477 |
| 2,831,437 | 4/1958 | Cromwell et al. | 417/477 |
| 3,340,817 | 9/1967 | Kemnitz | 417/475 |
| 3,403,942 | 10/1968 | Farnworth | 406/65 |
| 3,424,350 | 1/1969 | Herr et al. | 222/152 X |
| 3,669,574 | 6/1972 | Broadfoot | 417/477 |
| 3,754,683 | 8/1973 | Broadfoot | 222/134 |
| 3,862,780 | 1/1975 | Senn | 417/477 X |
| 4,286,910 | 9/1981 | Conrad | 222/450 X |
| 4,407,436 | 10/1983 | Broadfoot et al. | 417/477 X |

FOREIGN PATENT DOCUMENTS

| | | | |
|---|---|---|---|
| 2144234 | 9/1973 | France . | |
| 2199812 | 12/1974 | France . | |
| 2325827 | 4/1977 | France . | |
| 2336571 | 7/1977 | France . | |
| 7211427 | 2/1974 | Netherlands . | |
| 589553 | 7/1977 | Switzerland . | |
| 760548 | 10/1956 | United Kingdom | 406/120 |
| 2029514 | 3/1980 | United Kingdom . | |

*Primary Examiner*—Joseph J. Rolla
*Attorney, Agent, or Firm*—Seed and Berry

[57] ABSTRACT

A metering and/or feeding unit for fluid materials, particularly dry particulate materials and semifluid materials, is disclosed. An elastic-walled tube having an open feed end and an open discharge end is vertically oriented. A power-driven assembly, including tube rollers, are adapted to constrict the elastic tube, beginning at its upper end and progressively moving down the length of the tube. The material being metered or fed is introduced into the elastic tube at its upper end and is progressively moved down the length of the tube as the tube roller of the power-driven assembly moves down the length of the tube. A valve is provided to prevent entry of material into the feed end of the tube at periodic intervals and in coordination with constriction of the tube so that when a tube roller initially engages the tube near the feed end of the tube, that portion of the tube is substantially free of material. The material being fed may be discharged into a plenum through which a stream of pressurized gas is discharged to convey the material to a work location.

12 Claims, 12 Drawing Figures

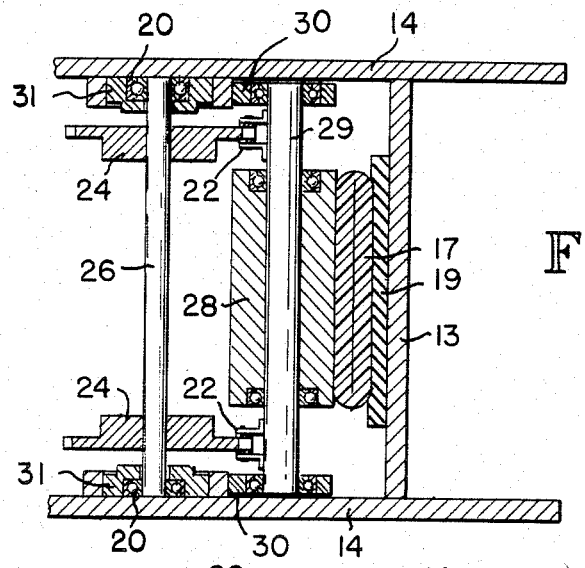
FIG. 3
FIG. 5A
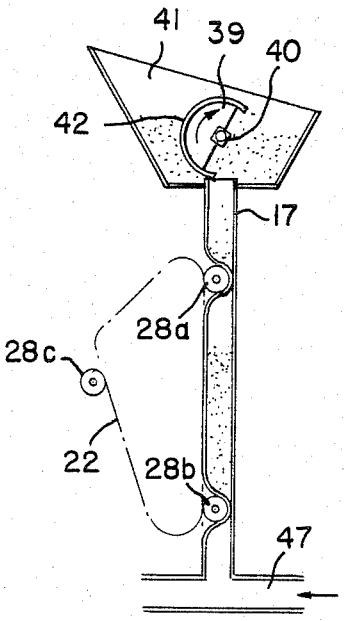
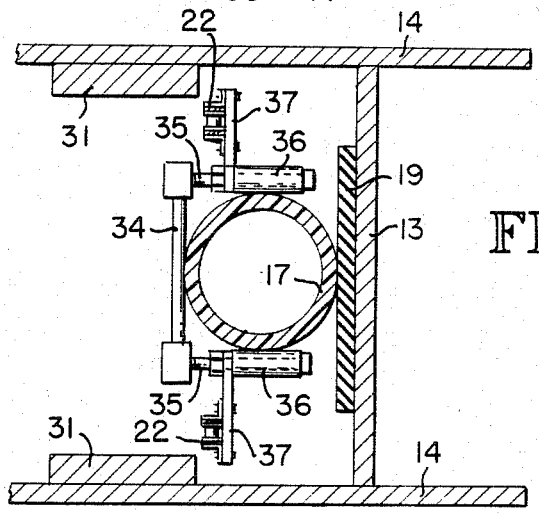
FIG. 4
FIG. 5B
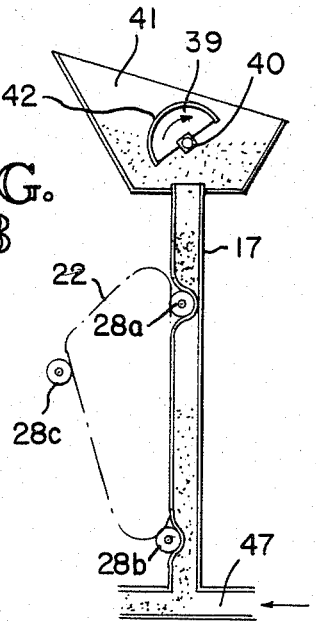
FIG. 5C
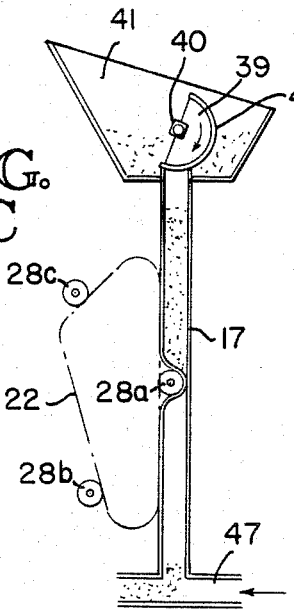
FIG. 5D
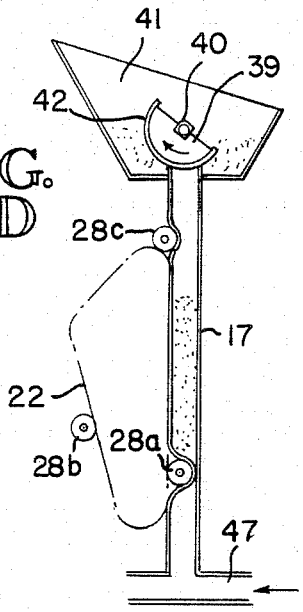

METERING AND/OR FEEDING UNIT FOR FLUID MATERIALS

DESCRIPTION

1. Technical Field

This invention relates to a method and apparatus for metering and/or feeding fluid materials, particularly dry particulate materials and semiliquid materials, into a pressurized or non-pressurized atmosphere.

2. Background Art

Finely divided particulate materials, such as Gunite, a sand-cement mixture, are difficult to feed. Several methods are known for feeding dry sand-cement mixtures to a nozzle with compressed air where it is wetted with a proper amount of water and appied to a work surface. In general, the prior art machines utilize a pressure vessel, pressurized multiple chambers or a tapered rotary valve.

The Allentown Pneumatic Gun Company manufactures a feeder having single or dual chambers. With dual chambers, the material is discharged by compressed air from a lower chamber while the upper chamber is being filled with material. An operator is required to cycle feeding of the material from the upper chamber to the lower. The upper chamber must be vented to the atmosphere before refilling.

Nucretor pneumatic spraying equipment manufactured by The Nucrete Group of Companies, Melbourne, Asutralia, consists of a paddle mixer which discharges the granular material being fed into a feed chamber. In the feed chamber, a chain drive with fixed circular discs pulls a continuous stream of material through a rubber tube. Partway down the length of the tube, a series of air jets blows the material from between the fixed discs through a hose. No pressure vessel is required; however, wear and maintenance are problems.

A further type of equipment, manufactured by Schurenberg Beton-Spritzmaschinen (SBS) GmbH of Essen, West Germany, utilizes a rotary-type, tapered valve having multiple chambers for feeding materials intermittently to a pressurized chamber. Wear and sealing of the tapered valve is a problem. Also, the chambers in the rotary valve, after discharge of the material, must be vented to the atmosphere before being refilled.

NSF Industries of Troy, Mich., manufactures a unit which employs a multi-chambered rotor mounted within a housing. Compressed air enters through a fixed rotor linear having an opening therein communicating with the chambers of the rotor and forces material from the respective chambers. Intradym AG of Switzerland manufactures a unit operating on a similar principle.

Because of the necessity of venting in certain of the machines in use today, production capacity is limited. Venting also creates dusting problems and results in a waste or pressurized gas.

Peristaltic pumps are known for pumping fluid and semifluid materials. U.S. Pat. No. 2,015,123 discloses a device for transferring blood to a recipient from a donor by pressing an elastic-walled tube filled with blood with a worm arranged parallel to the tube, the worm being rotated to impart a peristaltic movement to the tube. U.S. Pat. No. 2,629,333 discloses a liquid pump having an elastic-walled tube and a rotatable helical member engaging and progressively constricting the tube as the helical member is rotated. U.S. Pat. No. 3,669,574 discloses a peristaltic pump for underwater pumping of fluids.

U.S. Pat. No. 3,754,683 discloses a device for feeding dry particulate accelerator material for concrete into an airstream for entrainment which works in combination with a peristaltic pump.

DISCLOSURE OF INVENTION

A metering and feeding unit for fluid materials is disclosed employing at least one elastic-walled tube which is vertically oriented to hold the material to be fed. A power-driven assembly is positioned adjacent to and along the length of the tube having tube means for engaging a portion of the tube to collapse the tube against itself, starting at the feed end of the tube and working progressively toward the discharge end, where the tube is allowed to reinflate and the material in the tube is discharged from the discharge end of the tube. Valve means are provided to allow entry of the fluid material into the feed end of the tube at periodic intervals, the valve means working in coordination with the power-driven assembly so that when one of the tube means of the power-driven assembly initially engages the tube to collapse it, that portion of the tube is substantially free of material. The material may be discharged from the discharge end of the tube into a plenum through which a pressurized stream of gas is directed, the gas conveying the material to a work location. To provide a continuous flow of material, multiple units may be used or other means, as described hereafter, may be used.

BRIEF DESCRIPTION OF THE DRAWINGS

FIG. 3 is a horizontal cross-section of the unit along section lines 3—3 of FIG. 2;

FIG. 4 is a horizontal section of the unit along section lines 4—4 of FIG. 2;

FIGS. 5A to 5D are a series of schematic drawings illustrating the unit of FIG. 1 in operation;

BEST MODE FOR CARRYING OUT THE INVENTION

Figure 1:
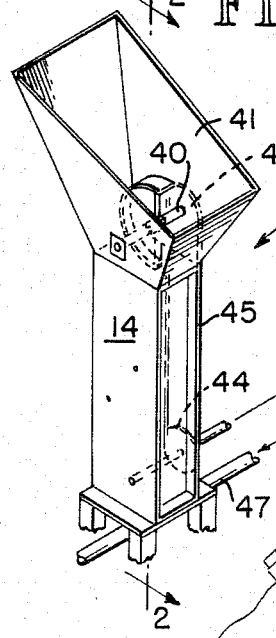
FIG. 1 is a perspective schematic view of the unit of this invention.
Figure 2:
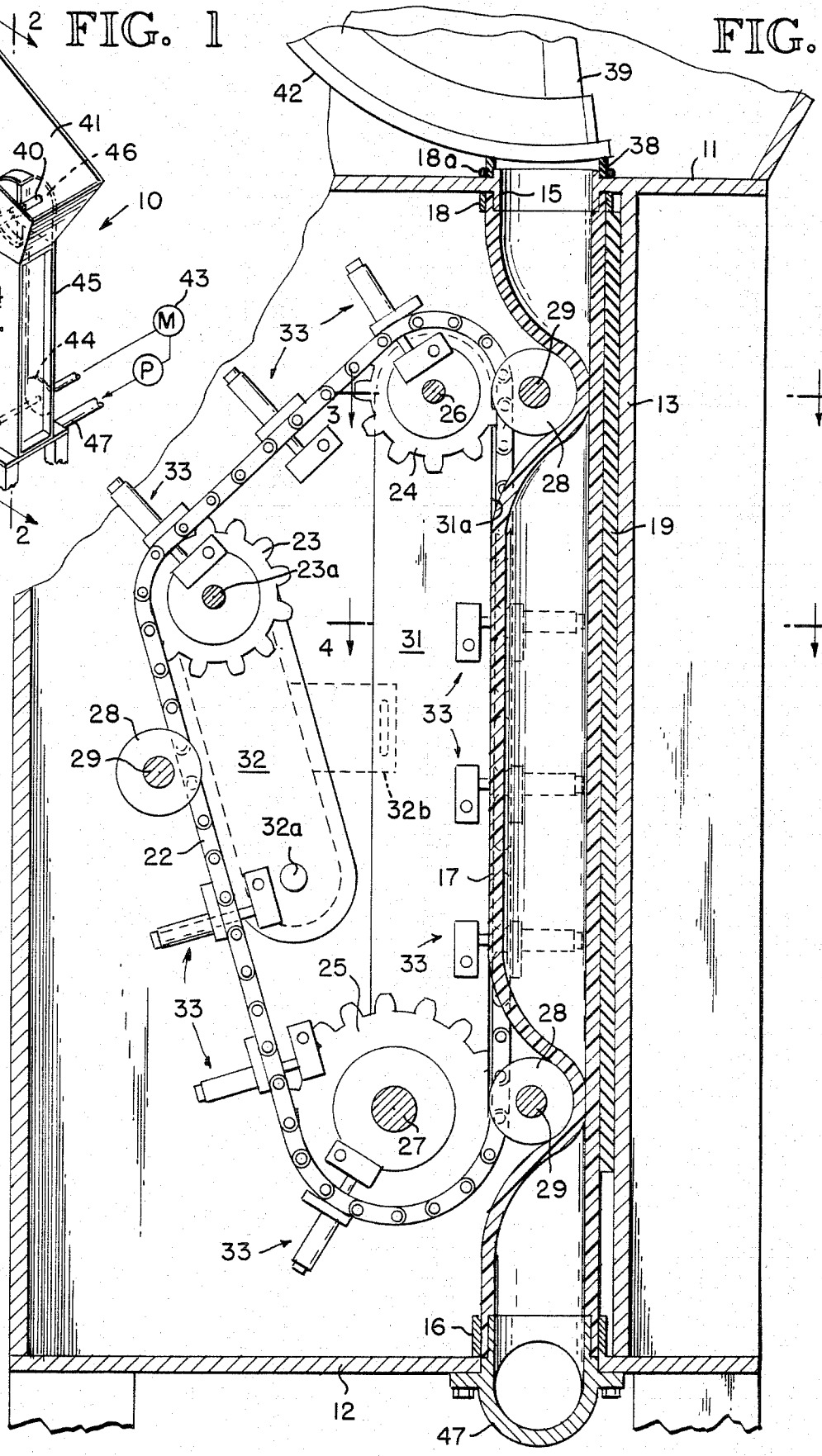
FIG. 2 is a vertical cross-section of the unit along section lines 2—2 of FIG. 1.

FIG. 1 illustrates a metering and/or feeding unit for fluid materials. The unit includes a housing 10 for the metering and feeding unit having an upper plate 11 and a lower plate 12 separated by intermediate support plate 13 and side plates 14. Openings are included in the upper and lower plates directly opposite each other, as illustrated in FIG. 2, the openings positioned adjacent to the support plate 13. The support plate 13 may be made adjustable relative to its distance from the respective openings 11 and 12, if desired. The opening in the upper plate 11 includes a flange 15 around the opening. The flange 15 extends above and below the surface of the upper plate 11.

An open-ended, elastic-walled tube 17 is tightly secured at its upper or feed end around the lower portion of flange 15 and at its lower or discharge end. The tube 17 is secured at its upper end by a band or clamp 18. A similar clamp 16 may be used for securing the lower or discharge end of the tube around the flange of the sleeve which extends into the opening in lower plate 12. The elastic tube 17 is preferably a woven, reinforced rubber material having a smooth surfaced interior wall. Its thickness may range from about $\frac{1}{4}$ to $\frac{3}{4}$ inch, preferably $\frac{1}{2}$ inch. Between the tube 17 and the support plate 13, a resilient pad 19 (suitably about $\frac{1}{2}$ inch in thickness) is provided which extends the length of the tube to provide a resilient backstop between the elastic tube and the support wall 13.

Mounted within the frame is a drive assembly which includes tube rollers mounted so as to engage a portion of the tube, beginning at its feed end, to collapse that portion of the tube against itself and then work progressively downwardly toward the discharge end of the tube, where the tube roller disengages from the tube to allow reinflation of the tube. The tube rollers are mounted at spaced intervals on an endless belt, as illustrated in FIG. 2. Referring to FIG. 2, a pair of chains 22 extend about spaced sprockets 23, 24 and 25. Sprockets 23, 24 and 25 are secured to respective shafts 23*a*, 26 and 27, the respective shafts journaled in bearings 20 secured, respectively, to the upper ends of plates 31 and 32, which are secured to the sidewalls 14 of the housing (see FIG. 3). The sprockets 24 and 25 are mounted sucn as to provide a run along virtually the entire length of the elastic tube 17. Mounted to the spaced chains at spaced intervals are three tube rollers 28, each journaled in respective bearings on shafts 29 for rotation about the respective shafts (see FIG. 3). Guide rollers 30 are journaled on the ends of the respective shafts 29, the guide rollers traveling along the forward edge of guide plate 31 secured to the respective sidewalls 14 of the unit. The guide surface 31*a* (see FIG. 2) ensures that each tube roller 28, once it engages the tube 17 at its upper or feed end (as illustrated in FIG. 2) to collapse the tube against itself, will maintain the tube in collapsed condition as it progresses along the entire length of the tube. Plates 32 are pivotally connected to the respective sidewalls 14 at 32*a*. A chain-tightening wedge 32*b* is provided for adjustment of sprocket 23 to tighten chains 22.

Pairs of side roller units 33 may be secured to the respective chains 22 between each of the tube rollers 28, as illustrated in FIG. 2. Each side roller unit 33 includes an elongated bracket 34 from which extend respective shafts 35. Rollers 36 are journaled for rotation on the respective shafts 35. Flanges 37, secured at one end to the shafts 35, are secured to the respective pairs of chains at their opposite ends. The distance between the pairs of rollers 36, as illustrated in FIG. 4, should be about the same as the diameter of the tube 17. The side roller units are designed to contact the walls of the tube after it has been collapsed by the tube rollers 28 and aid in reinflating the tube to the configuration illustrated in FIG. 4 from that illustrated in FIG. 3.

Referring to FIG. 2, a relatively short length of tubing 38 is secured around the feed opening in the upper plate 11 with a band or wire clamp 18*a*. The free end of the section of elastic tube 38 is closed and opened by valve means, such as an arcuate section of a wheel 39 secured above the feed opening for rotation to shaft 40. The shaft 40 is journaled for rotation to bearings secured to the sidewalls of a bin 41 which receives and holds the fluid material to be fed into the metering unit. The wheel 39 includes an arcuate surface portion 42 which engages the free end of the section of elastic tube 38 to seal the feed opening against entry of material into the tube 17 at periodic intervals. Rather than the valve means shown, a cam-operated sliding valve may be used or other valve means which functions to open and close the feed opening at appropriate times.

The drive assembly for the tube rollers and the wheel 39 are driven by suitable means, such as a motor 43 whose output shaft drives sprocket 25. The output shaft may have a sprocket 44 secured to it around which is trained chain 45 which is trained about sprocket 46 secured to shaft 40. The rotation rate of wheel 39 relative to that of the drive assembly is chosen to ensure that the feed end of the tube is sealed against entry of material when the tube rollers 28 initially engages the tube 17 at its upper end so that the tube is substantially free of material, thus allowing the tube to be collapsed against itself by the tube roller.

Method of Operation of the Unit

FIGS. 5A to 5D schematically illustrate operation of the unit. Referring first to FIG. 5D, the arcuate surface 42 of wheel 39 seals the feed end of the tube 17 against entry of material into the tube 17. Tube roller 28*c*, near the feed end of the tube, is just beginning to compress the tube 17 to collapse it against itself. Further down the length of the tube is material which has been previously fed into the tube during an earlier cycle, the material moving down the tube as the tube roller 28*a* progressively moves down the tube. Now referring to FIG. 5A, the upper tube roller 28*a* has completely collapsed the tube 17 against itself prior to the opening of the feed end of the tube by rotation of wheel 39. Referring to FIG. 5B, the lower tube roller 28*b* has reached the end of its run and is disengaging from the tube 17, allowing the material in the tube to be discharged from the tube. At the same time, material from the bin 41 continues to feed into the tube 17 at the upper end. Referring to FIG. 5C, the surface 42 of the arcuate wheel 39 closes off the feed end of the tube 17 prior to the tube roller 28*c* contacting the tube near its upper or feed end. The cycle of operation continues until all the material in the bin has been metered and fed.

Material discharged from the tube 17 may be discharged into a pressurized air plenum 47, as illustrated in FIGS. 1, 2 and 5, or discharged in any other manner desired.

Figure 6:
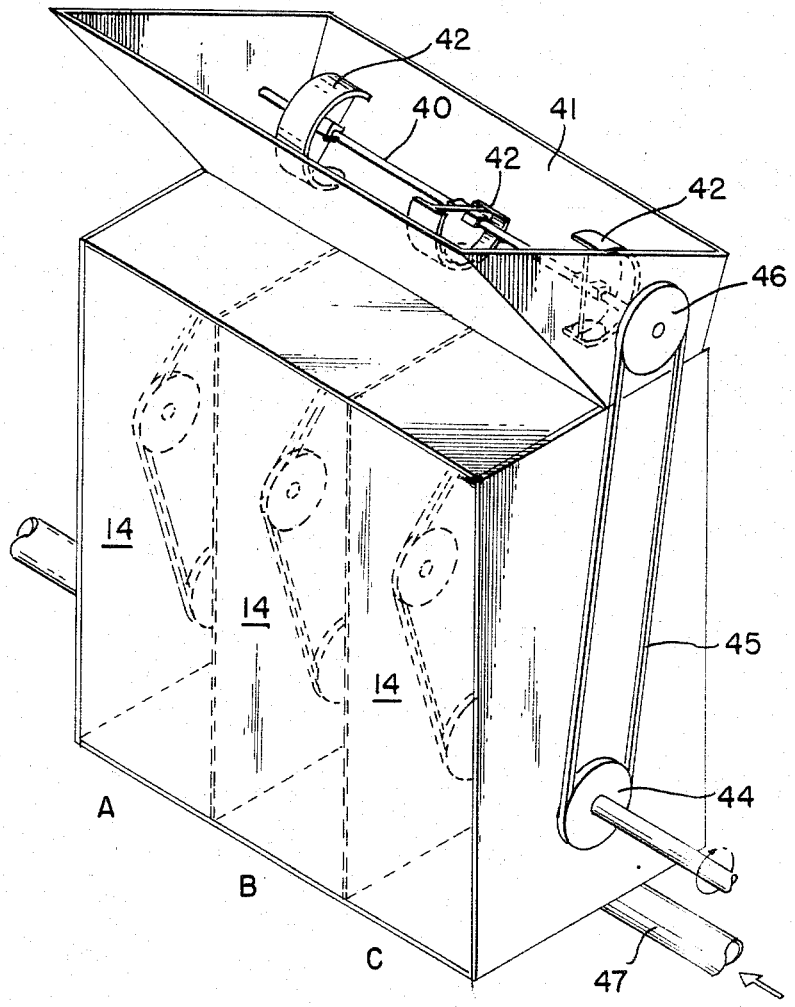
FIG. 6 is a perspective view of three units of the type shown in FIG. 1 mounted in side-by-side relationship for continuous feeding of material.
Figure 7:
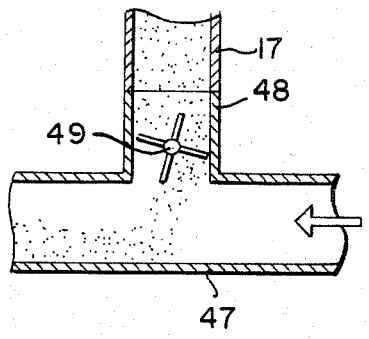
FIG. 7 is a partial cross-sectional view illustrating an alternative means for providing continuous flow of material from a unit such as shown in FIG. 1 into an air-pressurized plenum.
Figure 8:
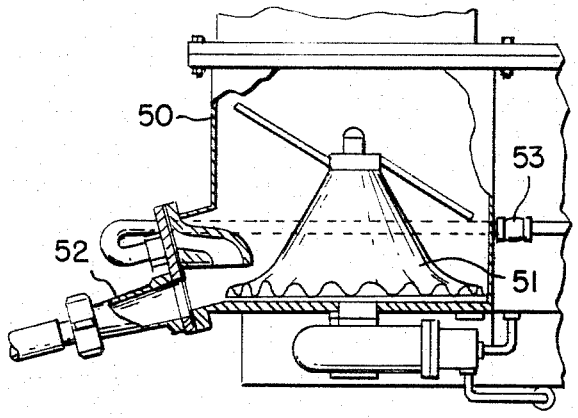
FIG. 8 is a partial view of still another alternative way of continuously feeding material from a metering and feeding unit of the type illustrated in FIG. 1.

It may be desirable for certain operations to provide a continuous flow of material rather than the discontinuous flow which one such metering and feeding unit provides. Continuous flow may be obtained in a number of ways, three of which are illustrated by FIGS. 6, 7 and 8. In FIG. 6, three side-by-side metering and feeding units are illustrated which are driven through a common drive shaft. The respective positions of the tube rollers 28 and arcuate circular members 39 of each unit are adjusted to provide a continuous flow of material into the air plenum 47 from the respective elastic-walled tubes in the three units. Referring to FIG. 6, diversion A the respective positions of the tube rollers 28 and the wheel 39 is such that the feed end has just been opened and a lower tube roller just disengaged from the tube to allow material in the tube to be fed into the plenum 47, as illustrated in FIG. 5B. The next adjacent units (FIG. 6, division B;) has its tube rollers 28 and wheel 39 in a position similar to that of FIG. 5D, where the material has been loaded into the tube and is progressively moving down the length of the tube but has not been discharged. The nest adjacent unit (FIG. 6, division C) has its tube rollers 28 and wheel 39 in a position similar to that shown in FIG. 5C, where loading of the material has just been completed and the feed end of the tube is just being sealed against further entry of material by the wheel 39. By staggering the cycles of the respective side-by-side units, a continuous flow of material can be provided to the air plenum 47.

FIG. 7 illustrates still another way of providing continuous flow of material to an air plenum 48. Referring to FIG. 7, an extension 48 of the tube 17 extends from the discharge end of the tube 17 to the air plenum 47. Mounted within that tubular extension is a rotatably mounted butterfly wheel 49 having spaced vanes extending from the central shaft of the wheel. The material discharged from tube 17 is prevented from entering the air plenum 47 all at once by the vanes of the butterfly wheel. The wheel is rotated at a rate sufficient to provide a continuous flow of material into the plenum as the material is discharged from the discharge end of the tube into the extension 48 above the butterfly wheel.

FIG. 8 illustrates still another method of providing continuous feed of material. In this instance, the discharge end of the unit is connected with a pneumatic feeder of the type manufactured by Schurenberg Beton-Spritzmaschinen (SBS) GmbH of Essen, West Germany. The material is discharged into a chamber 50 in which a rotating drum 51 is located. The chamber 50 includes a material outlet near its lower end. Pressurized air is fed through conduit 53, which discharges adjacent the discharge conduit 52 to entrain the material in the chamber and discharge it.

Figure 9:
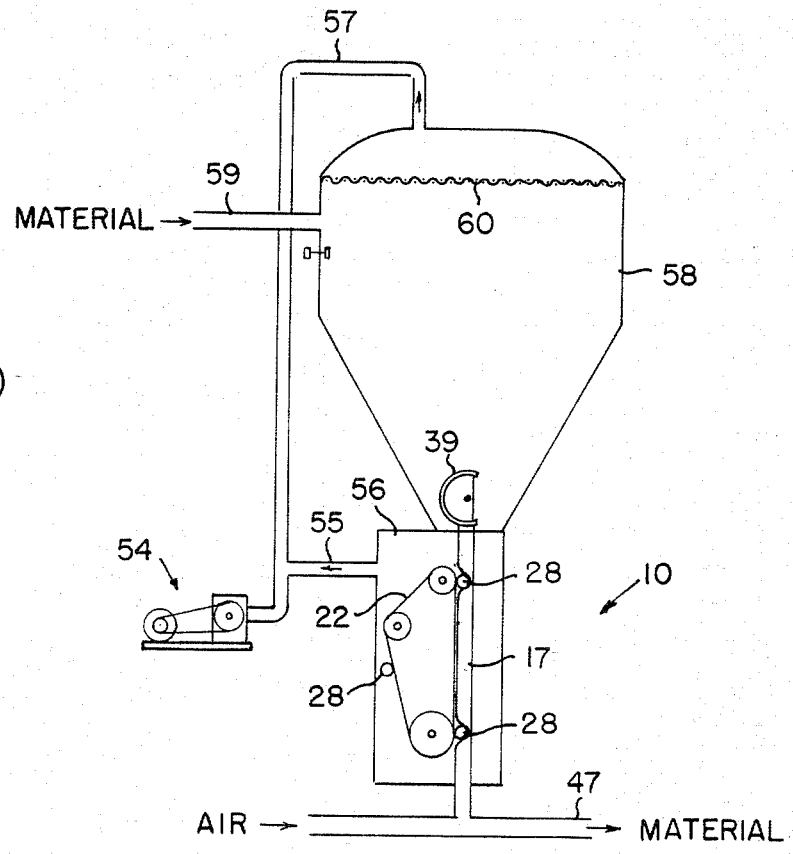
FIG. 9 is a schematic diagram of a vaccuum-pressure system employing a unit of the type illustrated in FIG. 1.

FIG. 9 illustrates a vacuum-pressure system making use of the metering and feeding unit of this invention. Referring to FIG. 9, the unit is encased in a housing 56 connected to a source of vacuum 54. This bin 58 above the unit holding the material to be fed is also connected to the vacuum 54 and to a material feed line 57. The vacuum created draws in the material to be fed through line 59 into the closed bin where it is fed into the feed end of the tube of the metering and feeding unit as previously described. A filter 60 may be provided in the bin to prevent material in the bin from being pulled into the vacuum unit 54. The vacuum drawn on the metering and feeding unit exteriorly of the tube aids in reinflation of the tube to its original contours after being collapsed by the respective tube rollers 28.

With the metering and feeding unit illustrated, it is possible to move relatively large volumes of fluid material economically and substantially maintenance free. For example, using a 3-inch diameter elastic tube, approximately 5 yards of material per hour can be removed. With a 4-inch diameter tube, approximately 8 yards per hour can be moved. With a 12-inch tube, utilizing 10-foot slugs of material between the respective tube rollers, and 30 slugs per minute being fed into an air plenum, about 523 cubic yards per hour of material can be moved. With 3 units, such as illustrated in FIG. 6, about 1569 cubic yards per hour can be moved.

We claim:

1. A metering and feeding unit for fluid material, comprising:

an open-ended, elastic-walled tube for receiving the material having an open feed end and an open discharge end;

a power-driven assembly positioned adjacent the length of the tube including spaced tube rollers mounted on a endless, flexible, drive belt which, in repeating cycles, engage the tube to collapse a portion of the tube against itself starting at the feed end of the tube and working progressively toward the discharge end where it disengages from the tube to allow reinflation of the tube and discharge of the material from the tube; and valve means coordinated to open the feed end of the tube after one of the spaced tube rollers of the power-driven assembly initially engages and collapses the portion of the tube at the feed end when that portion of the tube is substantially free of material.

2. The unit of claim 1 wherein the valve means includes an arcuate, rotatable member having a surface which periodically covers and uncovers the feed end of the tube on rotation.

3. The unit of claim 1 including at least one pair of side rollers mounted between and essentially at right angles to the spaced tube rollers for engaging the sidewalls of the tube, the side rollers engaging the sidewalls of the tube both before and after the tube is collapsed against itself by the tube rollers to aid in reinflating the tube.

4. The unit of claim 1 wherein the tube is vertically oriented.

5. The unit of claim 1 including a plenum communicating with the discharge end of the tube and a source of pressurized gas flowing through the plenum to convey the material discharged into the plenum.

6. The unit of claim 5, including a rotatable butterfly wheel mounted beneath the discharge end of the tube and before entry of the material being discharged into the air plenum, and means to rotate the butterfly wheel at a rate to provide a continuous flow of material being discharged from the tube into the plenum.

7. The unit of claim 5, including multiple metering and feeding units whose discharge ends of the respective tubes are connected to a common plenum and whose repeating cycles of infeed and discharge of material are staggered to provide a continuous feed of material into the plenum.

8. The unit of claim 1 wherein the tube and power-driven assembly are housed within a closed vessel.

9. The units of claim 8, including vacuum means to create a partial vacuum within the vessel.

10. The unit of claim 9, including a closed bin secured over the feed end of the metering and feeding device having a material inlet and a conduit connected to the vacuum means for creating a vacuum within the closed bin.

11. A metering and feeding unit for fluid materials, comprising:

a vertically oriented, elastic-walled tube receiving the material, having an open feed end and an open discharge end;

a power driven assembly, including an endless belt, tube rollers mounted at spaced intervals along the belt, and means for mounting the belt such that the main run of the belt is parallel to the length of the elastic tube and such that the spaced rollers periodically and repeatedly engage the tube to collapse it against itself, beginning initially at the feed end of the tube and working progressively toward the discharge end of the tube where the tube roller disengages from the tube to allow reinflation thereof and discharge of the material within the tube; and valve means coordinated to open the feed end of the tube after a tube roller of the power-driven assembly initially engages and collapses the tube against itself at the feed and thereof when that portion of the tube is substantially free of material.

12. A method of feeding fluid materials, comprising the steps of:

(a) feeding material into the feed end of an open-ended, elastic-walled tube collapsed against itself partway down the length of the tube, the material held in the tube above the point of collapse of the tube against itself;

(b) progressively moving the point of collapse of the tube downwardly toward the discharge end to allow the material in the tube to flow by gravity down the length of the tube;

(c) closing the feed end of the tube to prevent flow of material thereinto;

(d) collapsing the tube against itself near the feed end thereof above the material already in the tube;

(e) reinflating the collapsed portion of the tube near the discharge end thereof to allow the material held between the upper and lower collapsed portions of the tube to be discharged;

(f) opening the feed end of the tube to allow additional material to flow into the feed end of the tube partway down the length of the tube to the point of collapse of the tube against itself; and (g) repeating steps (a) through (f).

* * * * *